US006546776B2

(12) United States Patent
Wesolowski et al.

(10) Patent No.: US 6,546,776 B2
(45) Date of Patent: Apr. 15, 2003

(54) HIGH SPEED FINISHING BLOCK

(75) Inventors: Francis J. Wesolowski, Jefferson, MA (US); T. Michael Shore, Princeton, MA (US)

(73) Assignee: Morgan Construction Company, Worcester, MA (US)

( * ) Notice: Subject to any disclaimer, the term of this patent is extended or adjusted under 35 U.S.C. 154(b) by 0 days.

(21) Appl. No.: 09/912,445

(22) Filed: Jul. 24, 2001

(65) Prior Publication Data

US 2002/0100306 A1 Aug. 1, 2002

Related U.S. Application Data

(60) Provisional application No. 60/265,396, filed on Jan. 31, 2001.

(51) Int. Cl.[7] ..... B21B 13/12
(52) U.S. Cl. ..... 72/235; 72/249
(58) Field of Search ..... 72/226, 235, 249

(56) References Cited

U.S. PATENT DOCUMENTS 3,595,055 A * 7/1971 Rohde ..... 72/226
RE28,107 E * 8/1974 Wilson et al. ..... 72/235
4,129,023 A * 12/1978 Sieurin ..... 72/235
4,537,055 A * 8/1985 Woodrow et al. ..... 248/676
5,152,165 A * 10/1992 Shore et al. ..... 72/235
5,595,083 A * 1/1997 Shore ..... 72/234
5,673,584 A * 10/1997 Kuroda et al. ..... 72/11.5
6,053,022 A * 4/2000 Shore ..... 72/235
6,134,930 A * 10/2000 Shore et al. ..... 72/235

* cited by examiner

*Primary Examiner*—Lowell A. Larson
*Assistant Examiner*—John S Goetz
(74) *Attorney, Agent, or Firm*—Samuels, Gauthier, & Stevens, LLP

(57) ABSTRACT

A multi-stand block for a rolling mill comprises a plurality of roll stands alternately arranged on opposite sides of a pass line along which a product is rolled in a downstream direction from an entry end to an exit end of the block. Drive shafts are provided on opposite sides of the pass line. The drive shafts comprise coaxial segments interconnected by couplings, with each roll stand being connected to a respective one of the line shaft segments. A block drive is connected to the line shafts at the upstream end of the block, and the couplings are selectively disconnectable to mechanically isolate any downstream line shaft segments and the roll stands connected thereto from the block drive.

8 Claims, 3 Drawing Sheets

HIGH SPEED FINISHING BLOCK

CROSS REFERENCE TO RELATED APPLICATION

This application claims priority from Provisional Patent Application Ser. No. 60/265,396 filed Jan. 31, 2001.

BACKGROUND DISCUSSION

1. Field of the Invention

This invention relates generally to rolling mills, and is concerned in particular with an improvement in the finishing blocks of high speed rod rolling mills.

2. Description of the Prior Art

Referring initially to FIG. 1, a conventional high speed finishing block 10 is shown positioned on a mill pass line $P_L$. Product $P_R$ is received at the low speed entry end E of the block and exits from the block at the high speed delivery end D. The block is powered from the delivery end via a gear-type speed increaser 12 and a drive motor 14.

The block includes a succession of roll stands $\mathbf{16}_a$–$\mathbf{16}_h$ alternately staggered on opposite sides of the mill pass line $P_L$. The roll stands have cantilevered pairs of work rolls 18 alternately offset by 90° in order to effect twist free rolling of products. The successive roll stands on each side of the pass line are mechanically coupled one to the other and to the speed increaser 12 by parallel line shafts comprising coaxial line shaft segments 20 interconnected by gear-type couplings 22.

The successive roll stands $\mathbf{16}_a$–$\mathbf{16}_h$ are connected to respective line shaft segment 20 by bevel gears sets $\mathbf{24}_a$–$\mathbf{24}_h$. A shown by the plot line "x" in FIG. 2, the gear ratios of the successive bevel gear sets are designed to provide stepped increases in their pitch line velocities. The stepped increases are selected to keep pace with the progressively increasing speed of the product being rolled through the block. With this arrangement, the maximum attainable operating speed of the block is limited by the maximum pitch line velocity that can be designed into the bevel gear set of the last operating stand in the block, which in this case is the bevel gear set $\mathbf{24}_h$ of the stand $\mathbf{16}_h$.

Thus, for example, if the block is rolling a 7 mm round out of stand $\mathbf{16}_h$ at a rate of 120 to 130 tons per hour, and if the last two stands $\mathbf{16}_g$ and $\mathbf{16}_h$ are then "dummied" by removing their respective work rolls 18 in order to roll a larger 9 mm round out of stand $\mathbf{16}_f$, the maximum obtainable tonnage rate remains the same because the bevel gear sets of the dummied stands remain connected to the mill drive. Moreover, although the dummied stands $\mathbf{16}_g$ and $\mathbf{16}_h$ are now unloaded, since they continue to be driven off of the line shafts, their bearings, seals, etc. continue to wear.

There exists a need, therefore, for an improved finishing block in which roll stands can be selectively dummied to progressively increase product size, with the dummied stands being completely uncoupled from the mill drive, and with the mill drive arranged such that rolling speeds can be increased progressively to increase the tonnage rate of the larger products being rolled.

A finishing block capable of achieving these objectives in accordance with the present invention will now be described with reference to the accompanying drawings, wherein:

DESCRIPTION OF THE INVENTION

Figure 3:
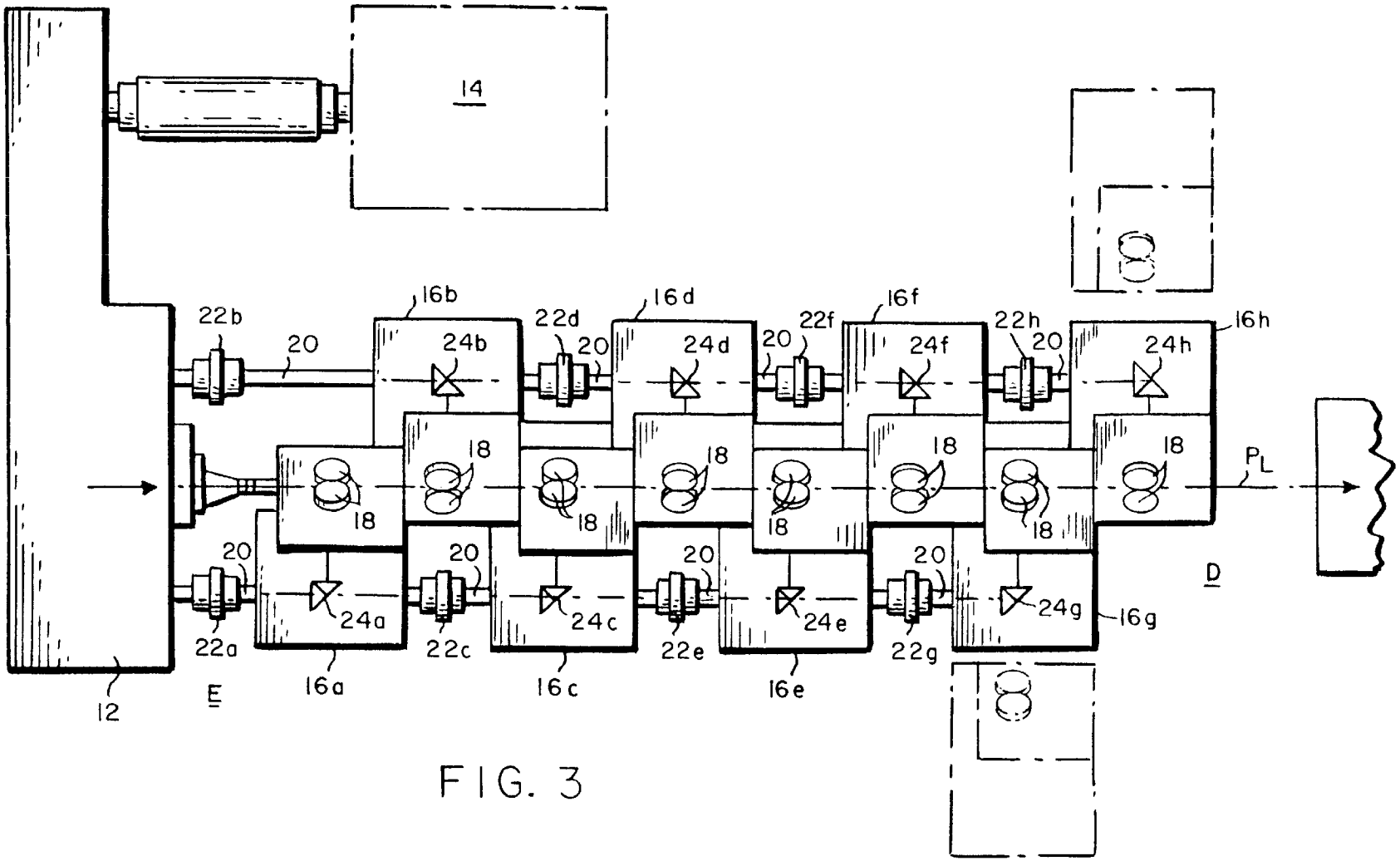
FIG. 3 is a plan view of a finishing block in accordance with the present invention.

In accordance with the present invention, as illustrated in FIG. 3, the block 10 is driven from the low speed entry and E by a multiple stage gear-type speed increaser 12 coupled to a laterally offset drive motor 14. The successive roll stands $\mathbf{16}_a$–$\mathbf{16}_h$ are again driven off parallel line shafts comprising coaxial line shaft segments 20 connected to the roll stands by bevel gear sets $\mathbf{24}_a$–$\mathbf{24}_h$. Here, however, the successive line shaft segments 20 are interconnected by clutchable gear-type couplings $\mathbf{22}_a$–$\mathbf{22}_h$ of the type that can be selectively engaged and disengaged. An example of a suitable clutchable gear type coupling is Model # FD204 supplied by Ameridrive Coupling Products of Erie, Pa., U.S.A.

Thus, with the rolling program referred to above, when shifting production from a 7 mm round to a 9 mm round, the couplings $\mathbf{22}_g$, $\mathbf{22}_h$ can be disengaged, allowing the last two dummied stands $\mathbf{16}_g$, $\mathbf{16}_h$ to be completely uncoupled from the mill drive. This avoids unnecessary wear of the bearings, seals, etc. of the dummied stands.

Figure 1:
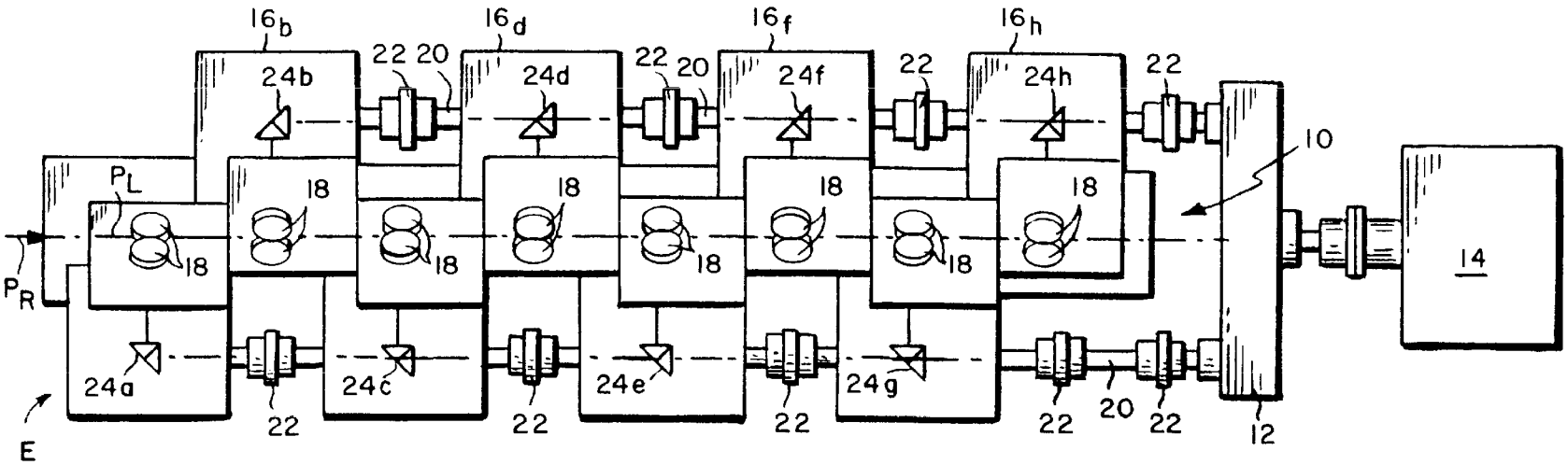
FIG. 1 PRIOR ART
FIG. 1 is a plan view of a conventional finishing block.
Figure 2:
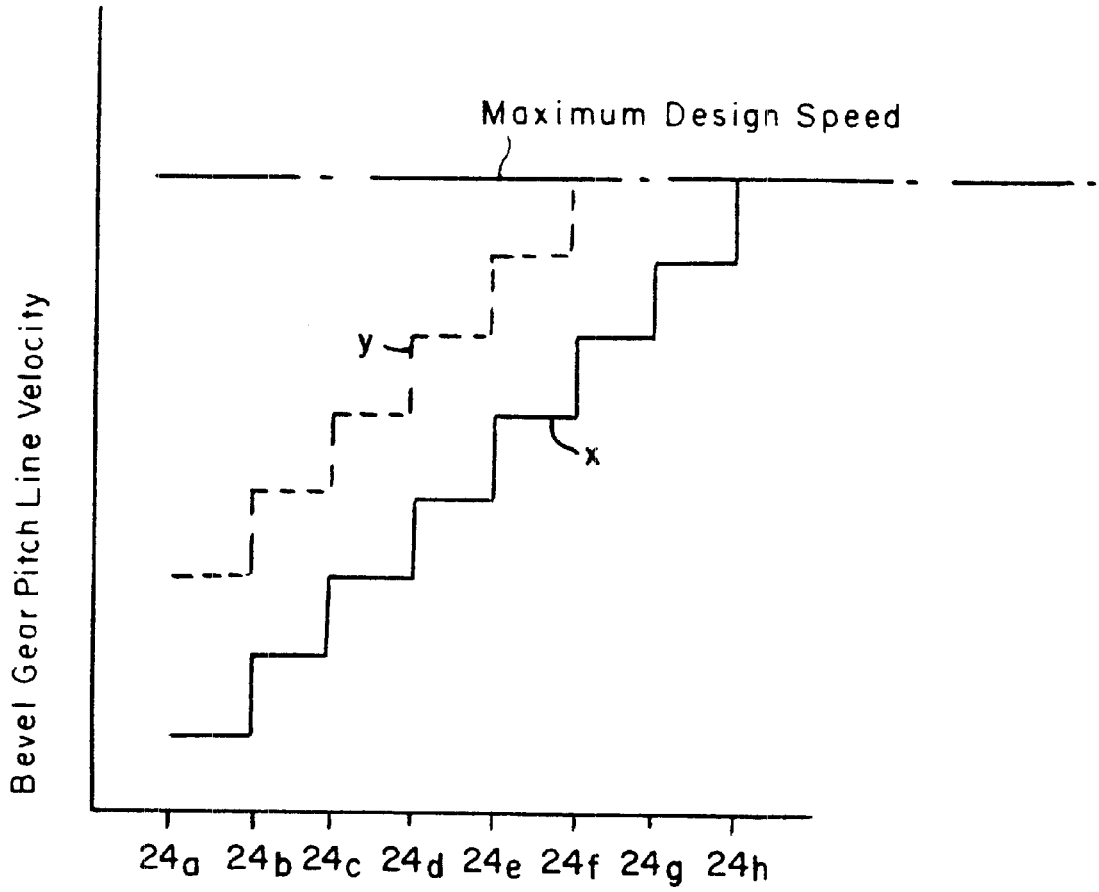
FIG. 2 is a graph showing bevel gear pitch line velocities of successive roll stands.

Also, as shown by the plot line "y" in FIG. 2, the block can be speeded up to now operate the bevel gear set $\mathbf{24}_f$ of the last active stand $\mathbf{16}_f$ at the maximum pitch line velocity previously assigned to gear set $\mathbf{24}_h$. This allows the remaining active stands of the block to be operated at a higher speed, making it possible to increase the tonnage rate of the mill to 150 tons per hour, and higher.

Again with reference to FIG. 3, with the drive arrangement of the present invention, since dummied stands are totally uncoupled from the mill drive, they may be removed on a system of rails (not shown) to off line locations indicated by the broken lines. When thus removed from the pass line, the roll stands may be serviced while the remainder of the block remains in operation.

We claim:

1. A multi-stand block for a rolling mill, comprising:

a plurality of roll stands alternately arranged on opposite sides of a pass line along which a product is to be rolled in a downstream direction from and entry end to an exit end of the block;

drive shafts on opposite sides of said pass line, each drive shaft including separate coaxial shaft segments interconnected by couplings;

means for connecting each of said roll stands to a respective one of said shaft segments; and a single block drive means connected to said drive shafts at the entry end of said block, said couplings being selectively disconnectable to mechanically isolate any downstream shaft segments and the rolls stands connected thereto from said block drive means.

2. The multi-stand block of claim 1 wherein said roll stands have work rolls arranged to roll the product in a twist-free manner.

3. The multi-stand block of claim 2 wherein the work roll axes of successive roll stands are alternately offset by 90°.

4. The multi-stand block of claim 1 wherein said couplings comprise clutchable gear-type couplings.

5. The multi-stand block of claim 1 wherein said roll stands are connected to respective ones of said shaft segments by intermeshed pairs of bevel gears, one bevel gear of each pair being carried on a shaft segment and the other bevel gear being carried on an intermediate shaft mechanically coupled to the work rolls of the respective roll stand.

6. The multi-stand block of claim 1 wherein said block drive means comprises a multi-gear speed increaser powered by a drive motor.

7. The multi-stand block of claim 6 wherein said drive motor is positioned to one side of said pass line.

8. A multi-stand block for rolling a single strand product being directed along a pass line, said block comprising:

first and second roll stands alternately arranged on opposite sides of said pass line, each of said roll stands having pairs of work rolls configured and arranged to roll said product in a twist-free manner;

first and second line shafts arranged on opposite sides of and extending in parallel relationship to said pass line from an entry end to a delivery end of said block;

means for selectively coupling and uncoupling said first and second roll stands, respectively, to and from said first and second line shafts; and a single drive means coupled to said line shafts at the entry end of said block for driving the roll stands coupled to said line shafts.

* * * * *